US005193520A

United States Patent [19]

Gostelow et al.

[11] Patent Number: 5,193,520

[45] Date of Patent: Mar. 16, 1993

[54] COOKING APPARATUS

[75] Inventors: Benjamin F. Gostelow, Alltami; Geoffrey J. E. Brown, Widnes, both of Great Britain

[73] Assignee: Stoves Limited, Merseyside, Great Britain

[21] Appl. No.: 875,281

[22] Filed: Apr. 29, 1992

[30] Foreign Application Priority Data

May 1, 1991 [GB] United Kingdom ..... 9109435

[51] Int. Cl.[5] ..... F24C 15/32

[52] U.S. Cl. ..... 126/21 A; 126/198; 126/273 R

[58] Field of Search ..... 126/21 A, 21 R, 19 R, 126/273 R, 273 A, 198

[56] References Cited

U.S. PATENT DOCUMENTS

| | | | |
|---|---|---|---|
| 3,889,099 | 6/1975 | Nuss | 126/198 |
| 3,889,100 | 6/1975 | Dills | 126/21 A |
| 3,911,893 | 10/1975 | Baker | 126/21 |
| 4,180,049 | 12/1979 | Carr et al. | 126/198 |
| 5,142,125 | 8/1992 | Fioroli et al. | 126/21 A |

FOREIGN PATENT DOCUMENTS

| | | | |
|---|---|---|---|
| 118383 | 9/1984 | European Pat. Off. . | |
| 330727 | 9/1989 | European Pat. Off. . | |
| 8800332.9 | 1/1988 | Fed. Rep. of Germany . | |
| 2207259 | 7/1973 | France . | |
| 1327366 | 8/1973 | United Kingdom . | |
| 1336803 | 11/1973 | United Kingdom . | |
| 1344138 | 1/1974 | United Kingdom . | |
| 1459472 | 12/1976 | United Kingdom . | |
| 1483802 | 8/1977 | United Kingdom . | |
| 2026685 | 2/1980 | United Kingdom | 126/21 R |

*Primary Examiner*—Carroll B. Dority

[57] ABSTRACT

A domestic cooker has a plenum chamber positioned to the rear of its oven cavity. Air is pump into the chamber by a fan which draws air around the outside of the cavity. Air exits from the chamber to atmosphere via a duct above the oven cavity having first passed over the cooker control panel to keep the latter at an acceptable temperature. The oven cavity has a door of a composite construction with inner and outer door panels spaced apart by a passageway open at the top and at the bottom of the door. Air from the plenum chamber flows to the passageway via a second duct located beneath the cavity. In another embodiment of the invention the cooker has two oven cavities each with a door of the composite construction, the passageways between the inner and outer panels of each door being supplied with air from a plenum chamber at the rear of the cavities.

9 Claims, 3 Drawing Sheets

COOKING APPARATUS

This invention relates to cooking apparatus and has particular reference to domestic gas and electric cookers.

Conventionally, such domestic cookers include an oven cavity heated by a gas burner or by electric heating elements.

The cookers also have a control panel usually mounted on the front of the cooker directly above the oven cavity. In that position, the control panel is exposed to heat emitted by the oven cavity when in use and such heat may be sufficient to harm electronic components, for example oven timers, mounted upon the control panel, and may also raise the temperature of control knobs excessively. In the past, it has been usual to surround the oven cavity with thermal insulation but this may not be sufficient to protect the more heat sensitive electronic components from damage. It has also been proposed to draw air around the oven cavity by means of a fan located on the top of the oven cavity and to discharge such air through a duct also located on the top of the oven cavity and positioned between the latter and the control panel thereby providing a thermal barrier between the oven cavity and the control panel so keeping the latter at an acceptable temperature.

It is an object of the present invention to provide an improved arrangement for maintaining an effective thermal barrier between the control panel and the oven cavity and which is also able to provide cooling for other cooker components.

According to the present invention a cooker includes an oven cavity, heating means for heating the cavity, a plenum chamber positioned at the rear of the cavity, the chamber having at least one air inlet for air to flow into the chamber, at least one air outlet through which air leaves the chamber, fan means for drawing air into the chamber through the air inlets and discharging it through the or each air outlet, and an air outlet passageway for conveying air from an air outlet to a selected part of the cooker.

The cooker may have a cooker control panel, and in this case, the outlet passageway conveys air towards the panel and discharges it close to the panel.

In another embodiment, the outlet passageway conveys air to an oven door or doors where the air is directed to flow through the door or doors to maintain the outer surface of the latter at a safe temperature.

In one embodiment of the invention, the outlet passageway is so constructed that it discharges air over the control panel and out through one or more discharge orifices located beneath the control panel.

Preferably, the plenum chamber has at least one additional air outlet that communicates with a further air flow passageway for directing air towards a closure for the oven cavity. The closure is of a composite construction having spaced inner and outer door panels, air from the further passageway flowing through the space between the panels.

By way of example only, embodiments of the invention will now be described in greater detail with reference to the accompanying drawings of which:

Figure 1:
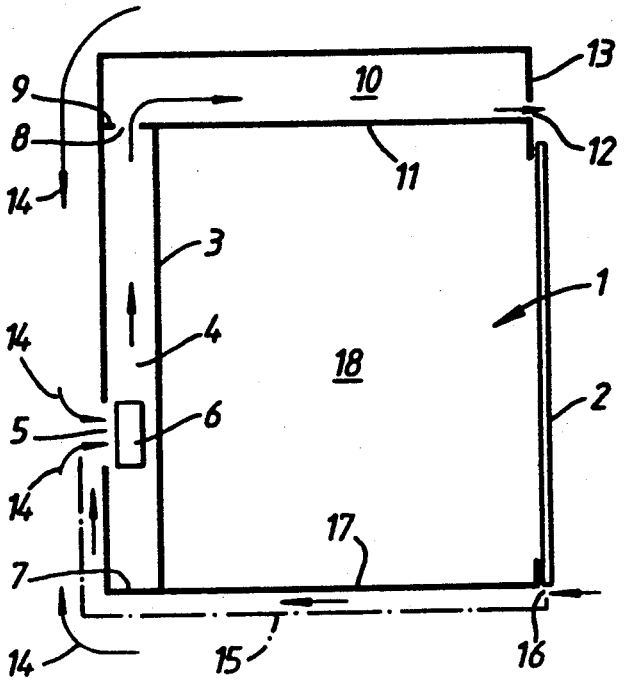
FIG. 1 is a section in diagrammatic form only of a first embodiment.

FIG. 1 is a vertical section in diagrammatic form only of a domestic cooker having an oven cavity 1 with an oven door 2 providing access to the interior of the cavity. It will be understood that the oven cavity is fitted with supports for oven shelves on which food to be heated is placed. Neither the supports nor the shelves are shown in FIG. 1.

Located at the rear of the oven cavity behind the rear wall 3 thereof is a plenum chamber 4 which may extend across the entire width of the rear wall 3. The chamber 4 has an air inlet 5 aligned with the "eye" of a centrifugal fan 6 housed in the chamber 4 at a location spaced from the lower wall 7 of the chamber 4. The chamber 4 also has an air outlet 8 in its upper wall 9. The outlet 8 communicates with an outlet duct 10 above the roof 11 of the cavity 1. The duct 10 terminates in a series of outlet orifices 12 spaced across the front of the cooker beneath a control panel 13 also positioned above the cavity 1. The duct 10 may extend across the entire width of the oven cavity roof 11 or it may be of a smaller dimension adjacent the outlet 8 and diverge smoothly to the outlet orifices 12 where its dimension equals that of the full width of the cavity.

The fan 6 is driven by an electric motor which may be an integral part of the fan. The motor has a control circuit which energises it automatically when the oven is brought into use. Energisation may occur immediately the oven is brought into use or there may be a predetermined time delay before energisation takes place.

The fan 6 draws air around the outside of the oven cavity as indicated by the arrows 14 and into the plenum chamber 4 via the air inlet 5. The fan discharges the air into the plenum chamber thus creates a positive pressure within the latter and a resultant air flow through the outlet 8 and into the duct 10. The air leaves the duct 10 via the orifices 12. The air flow carries heat emitted from the oven cavity to and out of the orifices 12 and so reduces considerably the extent to which heat emitted by the oven cavity is able to raise the temperature of the control panel and in that way components on the control panel are protected against overheating.

If desired, an air inlet duct 15 may be provided beneath the oven cavity for conveying air at ambient temperature directly to the fan inlet from air inlet apertures 16 in the front wall of the cooker beneath the oven door 2.

The oven cavity may be heated by a gas burner (not shown) mounted on or beneath the floor 17 of the cavity or by electric heating elements mounted on or beneath the floor 17 or on the side walls 18 of the cavity. When a gas burner is used, at least some of the air required for combustion may be supplied from the plenum chamber 4.

Figure 2:
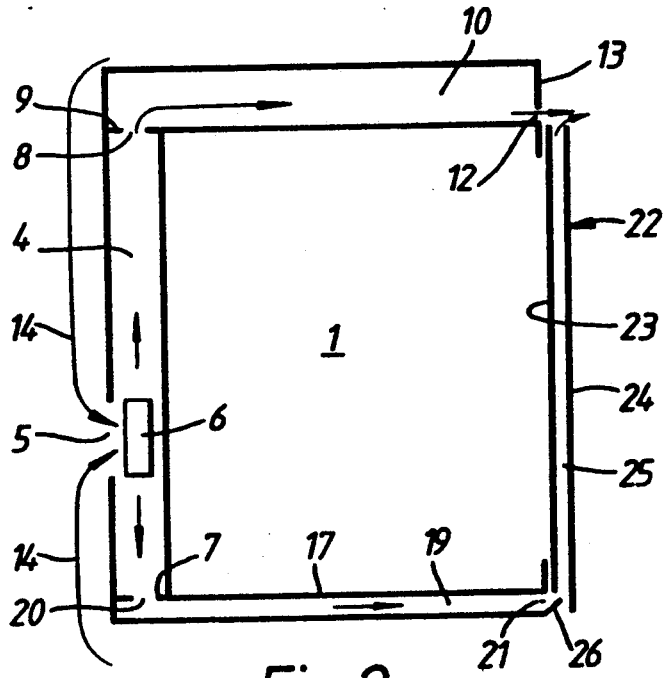
FIG. 2 is a section in diagrammatic form only of a second embodiment.

The construction of the embodiment shown in FIG. 2 is generally similar to that of the embodiment of FIG. 1 and similar components have the same reference numbers as in FIG. 1. Additionally, the embodiment of FIG. 2 has a duct 19 beneath the floor 17 of the oven cavity 1 and which communicates with, at one end the chamber 4 via one or more exit holes 20 in the floor 7 of the chamber, and at the other end a series of exit holes 21 spaced across the width of the front of the cooker in the front wall thereof.

The embodiment of FIG. 2 also has an oven door 22 of a composite construction having a door frame that supports inner and outer door panels 23, 24 separated by a vertical passageway 25 open at the top and at the bottom of the door.

At its lower edge the door 22 is contoured in a manner such that the door fits over the exit holes 21 and such that those holes are in communication with the passageway 25.

The fan 6 is driven by an electric motor which may be an integral part of the fan. The motor has a control circuit which energises it automatically when the oven is brought into use. Energisation may occur immediately the oven comes into use or there may be a predetermined time delay before energisation take place.

When the oven is in use, the inner panel 23 is heated by heat generated within the oven cavity and air flow through the passageway 25 extracts heat from the inner panel and conveys it to the atmosphere through the upper open end of the passageway. The upward movement of air in the passageway is assisted by the natural convectional movement of air in the passageway. Air flow through the passageway 25 maintains the temperature of the outer door panel 24 at a safe temperature thereby eliminating the risk of injury to a user who inadvertently touches the panel.

Preferably, the flow of air from the holes 21 to the passageway 25 is assisted by a scoop 26 which may be a part of the door or it may be mounted on the front of the cooker.

Figure 3:
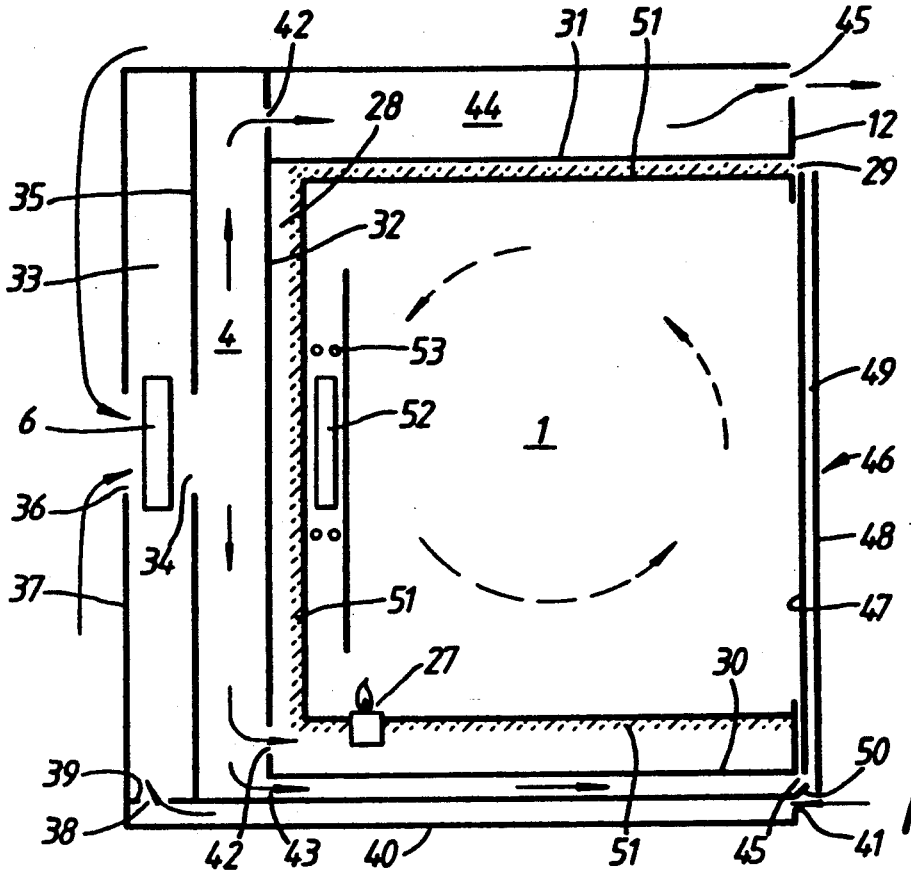
FIG. 3 is a section in diagrammatic form only of a third embodiment.
Figure 4:
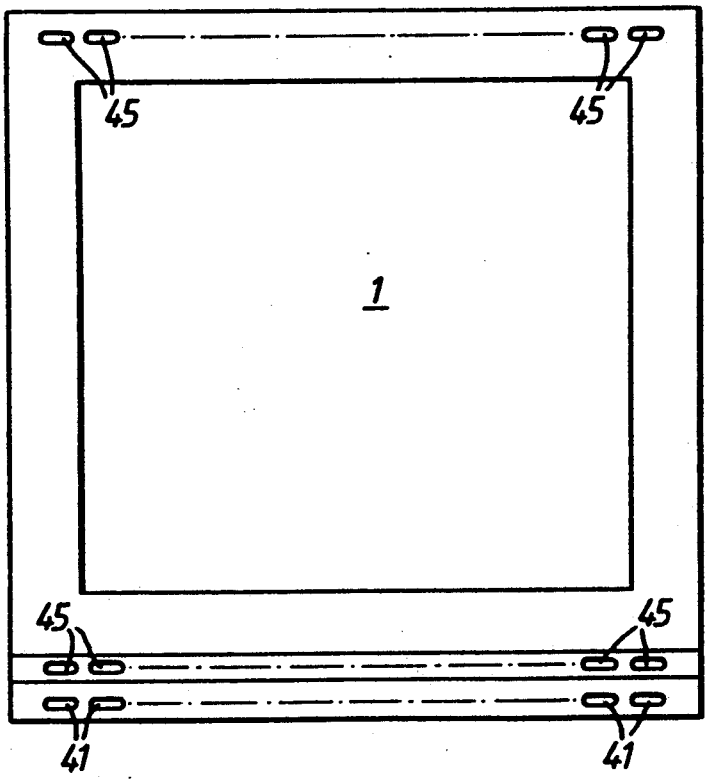
FIG. 4 is a view in diagrammatic form only of part of the front of the embodiment of FIG. 3, and, FIG. 5 is a section in diagrammatic form only of a fourth embodiment.

FIG. 3 is a section similar to that of FIG. 1 of a third embodiment of the invention. Some components of the third embodiment correspond with components of the first embodiment and these components have the same reference numbers as in FIG. 1.

In the embodiment of FIG. 3, the oven cavity 1 is heated by a gas burner shown diagrammatically at 27. The oven cavity is contained within an enclosure 28 open at 29 to give access to the interior of the cavity. The enclosure 28 has a floor 30, a roof 31 and a back wall 32. Behind the back wall 32 is the plenum chamber 4 into which air is pumped by the fan 6 that is accommodated within a second chamber 33. Air passes into the plenum chamber 4 via an inlet opening 34 in the rear wall 35 of the plenum chamber. Air is drawn into chamber 33 through inlet apertures 36 in its rear wall 37, and via further inlet apertures 38 in its floor 39. Apertures 38 provide communication from an inlet duct 40 beneath the floor 30 of the enclosure. Inlet duct 40 terminates in a series of inlet holes 41 spaced across the front of the cooker beneath the opening 29.

Air is able to leave the plenum chamber 4 through exit holes 42 in the back wall 32 and via further exit holes 43 just above the duct 40.

Holes 42 allow air to flow from the plenum chamber 4 into the space between the cavity and the enclosure accommodating the former. Some of that air reaches the burner 27 and provides combustion air therefor.

Holes 42 allow air to flow from the plenum chamber 4 into a duct 44 above the floor 31 and thence to a series of exit holes 45 spaced across the front of the cooker beneath the cooker control panel shown diagrammatically at 12.

The fan 6 is driven by an electric motor which may be an integral part of the fan. The motor has a control circuit which energises it automatically when the oven is brought in to use. Energisation may occur immediately the oven is taken into use or there may be a predetermines time delay before energisation takes place.

The cavity 1 has a door shown diagrammatically at 46. The door 46 is of a composite construction comprising a door frame supporting inner and outer door panels 47, 48 spaced apart by a passageway 49 open at the top and the bottom of the door.

At its lower edge, the door 46 is so contoured that, when closed, it fits over the holes 45 so channelling air from the holes 45 into the passageway 49 in the door. That air flow is in an upward direction and so is assisted by the natural convection flow of the air. The air flow keeps the temperature of the outer panel 48 at a safe level thereby eliminating the risk of injury to a user who inadvertently touches the panel.

Preferably, air from the holes 45 is directed into the passageway 49 by a scoop 50 located on the door structure or on the front of the cooker.

The cavity may be lined externally with a layer of thermally-insulating material thereby reducing the emission of heat from the cavity. In FIG. 2, the layer is shown diagrammatically at 51.

Mounted on the inner face of the back wall of the oven cavity is an electrically-driven centrifugal fan 52 which, when the oven is in use, is energised to circulate air within the cavity to ensure that all parts of the latter are at the same temperature.

The oven may be heated by an electric heating element or elements instead of a gas burner. FIG. 3 shows a heating element in diagrammatic form only at 53. The element is of an annular form and is located round the fan 52 and lies in the path of air discharged from the fan.

Figure 5:
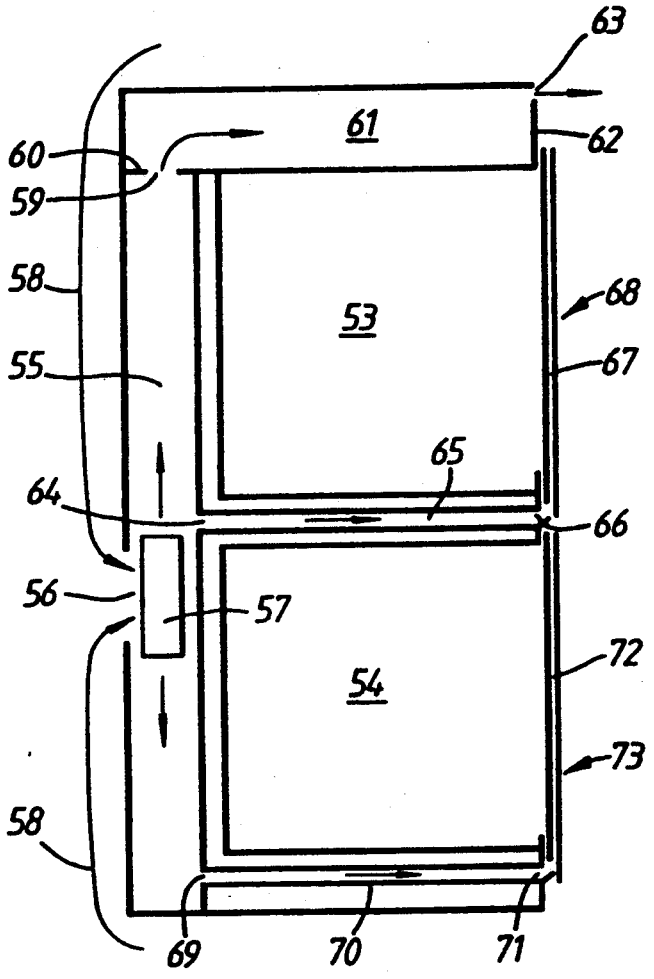

The embodiments described above all have single ovens only. However, the invention may also be embodied in cookers with double ovens and such a cooker is shown in schematic form only in FIG. 5.

The cooker has two oven cavities 53, 54 disposed one above the other. To the rear of both oven cavities is a plenum chamber 55 with an air inlet 56 disposed in line with the "eye" of a centrifugal fan 57. The fan 57 draws air from around the cooker chassis and the oven cavities as indicated by the arrows 58 and discharges it into the plenum chamber at a positive pressure.

The fan 57 is driven by an electric motor which may be an integral part of the fan. The motor has a control circuit which brings it into use when one or other of the ovens is brought into use. Energisation may takes place immediately or there be a predetermined time delay before energisation takes place.

One or more outlets 59 in the top wall 60 of the chamber 55 allow air from the latter to enter an outlet duct 60 above the upper oven cavity 52. Air flowing in the duct 61 passes round the cooker control panel indicated diagrammatically at 62 and so cools it. Air leaves the duct 60 to atmosphere via a series of outlet holes 63 spaced across the front of the cooker above the control panel 62.

A second outlet or outlets 64 allow air from the plenum chamber 55 to pass into a second duct 65 positioned between the upper and lower oven cavities 53, 54. Duct 65 terminates in a series of outlet holes 66 spaced across the front of the cooker and aligned with the lower open end of a passageway 67 between inner and outer door panels of the upper oven cavity door 68. Door 68 is of the composite construction described above. Air leaves the passageway 67 to atmosphere via its upper open end adjacent the control panel. A scoop may be fitted to assist the flow of air from the duct 65 to the passageway 67.

A third outlet or outlets 69 allows air from the plenum chamber 55 to enter a third outlet duct 70 beneath the lower oven cavity 54. Duct 70 terminates in a series of outlet holes 71 spaced across the front of the cooker and aligned with the lower open end of a passageway 72 between the inner and outer door panels of the lower oven cavity door 73. Door 73 is also of the composite construction described above. Air leaves the passageway 72 at the upper open end thereof. Air flow from the duct 70 to the passageway 72 may be assisted by a scoop.

Air flow through the passageways 67 and 72 maintains the temperature of the outer door panels of the doors 67 and 72 at a safe temperature so minimising the risk of injury to a user who inadvertently touched the outer panel.

The cavities 53 and 54 may be heated by gas burners or by electric heating elements and where a gas burner is employed, some at least of the combustion air required by the burner may be supplied from the plenum chamber 55.

One or both of the cavities 53, 54 may be fitted with air circulating fans similar to fan 50 referred to above in connection with the embodiment shown in FIG. 3.

We claim:

1. A cooker having two oven cavities each having heating means and a door of a composite construction including inner and outer door panels spaced apart by a passageway open at or adjacent the top and at or adjacent the bottom of the door, means forming a plenum chamber located at the rear of the cavities, the chamber having at least one air inlet connected to the ambient through which air enters the chamber and at least one air outlet through which air leaves the chamber, a fan for pumping air into the chamber through the or each air inlet, means forming a first air outlet duct directing the flow of air from an air outlet to the passageway of one of the doors and discharging said air from said door passage to the ambient, and means forming a second air outlet duct directing the flow of air from an air outlet to the passageway of the other door and discharging said air from said door passage to the ambient.

2. A cooker as claimed in claim 1 in which the oven cavities are arranged one above the other, and in which the first air flow duct is located between the cavities, and the second duct is located beneath the lower cavity.

3. A cooker as claimed in claim 1 in which air is directed into the respective passageways between the door panels via the lower ends thereof.

4. A cooker as claimed in claim 1 in which air is directed into the respective passageways by scoops.

5. A cooker having an oven cavity, heating means in said cavity for heating the cavity means forming a plenum chamber located at the rear of the cavity, the chamber having at least one air inlet connected to the ambient for air to flow into the chamber and at least one air outlet through which air leaves the chamber, fan means for pumping air into the chamber from an air inlet and discharging it through an air outlet, an oven cavity door of a composite construction having inner and outer door panels spaced apart by a passageway open at or adjacent the top and at or adjacent the bottom of the door, and means forming an air flow passageway for directing air from the air outlet into the passageway between the door panels and to discharge said air from between said door panels to the ambient.

6. A cooker as claimed in claim 5 in which air is directed into the passageway between the door panels via the lower end thereof.

7. A cooker as claimed in claim 5 further comprising means forming an air inlet duct connected to an air inlet for conveying air from the atmosphere to the chamber, and in which the air flow passageway is positioned between the oven cavity and the air inlet duct.

8. A cooker as claimed in claim 5 in which air is directed from the air flow passageway to the passageway between the door panels by a scoop.

9. A cooker having an oven cavity, heating means for heating the cavity means forming a plenum chamber located at the rear of the cavity, the chamber having at least one air inlet connected to the ambient for air to flow into the chamber and at least one air outlet through which air leaves the chamber, fan means for pumping air from around the oven cavity into the chamber via an air inlet and discharging it through each air outlet, a cooker control panel means forming an air flow passageway connected to one of the air outlets for conveying air towards the control panel and discharging the air to atmosphere via one or more discharge orifices located adjacent to the control panel means forming an air inlet duct located beneath the oven cavity for conveying air to one of the air inlets, and an oven cavity door of a composite construction having inner and outer door panels spaced apart by a passageway open at or adjacent the top and at or adjacent the bottom of the door and in which there are means forming a further air flow duct for directing air from the plenum chamber into the passageway between the door panels and to discharge said air from between said door panels to the ambient.

* * * * *